US009243369B2

(12) United States Patent
Huang

(10) Patent No.: US 9,243,369 B2
(45) Date of Patent: Jan. 26, 2016

(54) METHOD FOR MAKING A SHOEBOX

(71) Applicant: Yu-Chun Huang, Taichung (TW)

(72) Inventor: Yu-Chun Huang, Taichung (TW)

( * ) Notice: Subject to any disclaimer, the term of this patent is extended or adjusted under 35 U.S.C. 154(b) by 0 days.

(21) Appl. No.: 14/296,985

(22) Filed: Jun. 5, 2014

(65) Prior Publication Data

US 2015/0007954 A1 Jan. 8, 2015

(30) Foreign Application Priority Data

Jul. 5, 2013 (TW) ..... 102124117 A

(51) Int. Cl.
*D21J 7/00* (2006.01)
*B65D 1/22* (2006.01)

(52) U.S. Cl.
CPC .. *D21J 7/00* (2013.01); *B65D 1/225* (2013.01)

(58) Field of Classification Search
CPC ..... B65D 1/225; B65D 2543/00194; B65D 5/5021; B65D 5/6626; B65D 65/38; B65D 85/187; B31B 2203/00; B31B 3/26; B31B 3/64; B29K 2001/00; D21F 11/006; D21J 3/00; D21J 3/12; Y10S 229/93; Y10S 229/931
See application file for complete search history.

(56) References Cited

U.S. PATENT DOCUMENTS

| | | | | | |
|---|---|---|---|---|---|
| 2,515,113 | A * | 7/1950 | Chaplin | 162/223 |
| 2,762,549 | A * | 9/1956 | Van Dyke | 229/406 |
| 2,780,401 | A * | 2/1957 | Stevens | 229/406 |
| 2,808,976 | A * | 10/1957 | Chaplin | 229/406 |
| 2,872,093 | A * | 2/1959 | Chaplin | 229/406 |
| 2,941,708 | A * | 6/1960 | Crane et al. | 229/406 |
| 3,104,795 | A * | 9/1963 | Adams | 229/155 |
| 3,156,371 | A * | 11/1964 | Harrison | 220/6 |
| 3,284,284 | A * | 11/1966 | Wells | 162/218 |
| 3,316,102 | A * | 4/1967 | Doll et al. | 426/129 |
| 3,401,079 | A * | 9/1968 | Wells | 162/219 |
| 3,445,052 | A * | 5/1969 | Lewallen | 428/158 |
| 3,790,064 | A * | 2/1974 | Kramer | 229/117 |
| 4,866,232 | A * | 9/1989 | Stone | 219/730 |
| RE34,829 | E * | 1/1995 | Stone | 219/730 |
| 5,709,913 | A * | 1/1998 | Andersen et al. | 428/34.5 |
| 5,816,484 | A * | 10/1998 | Buchalski et al. | 229/117.15 |
| 6,645,348 | B2 * | 11/2003 | Kumamoto et al. | 162/220 |
| 7,021,024 | B2 * | 4/2006 | Kari | 53/397 |
| 7,909,964 | B2 * | 3/2011 | Nilsson et al. | 162/226 |
| 8,246,784 | B2 * | 8/2012 | Nilsson et al. | 162/226 |
| 2003/0173249 | A1 * | 9/2003 | Nemoto | 206/592 |
| 2005/0150624 | A1 * | 7/2005 | Toh et al. | 162/218 |
| 2014/0274632 | A1 * | 9/2014 | Tilton | 493/56 |
| 2014/0360899 | A1 * | 12/2014 | Huang | 206/278 |
| 2015/0007954 | A1 * | 1/2015 | Huang | 162/111 |

* cited by examiner

*Primary Examiner* — Jose Fortuna
(74) *Attorney, Agent, or Firm* — Patent Office of Bang Shia

(57) ABSTRACT

A method for making a shoebox includes preparing a pulp tank and a mold which includes a first upper mold, a first lower mold and a second lower mold; a step of forming a flat sheet of a semi-final product which includes closing the first upper and lower molds to produce the semi-final product; a step of vacuum suction and mold movement which includes vacuum sucking the semi-final product to the first upper mold, moving the first upper mold to above the second lower mold; a step of hot pressing of the semi-final product into a flat sheet of a final product with patterns and fold lines by closing and heating the first upper mold and the second lower mold; and a step of separating the first upper mold and the second lower mold, taking out the final product and folding it into a shoebox.

3 Claims, 13 Drawing Sheets

METHOD FOR MAKING A SHOEBOX

BACKGROUND OF THE INVENTION

1. Field of the Invention

The present invention relates to a shoebox, and more particularly to a method for making a shoebox.

2. Description of the Prior Art

As shown in FIGS. 1A-1B, a method for making a shoebox usually comprises: using a molding machine to form three layers of large sheets, which include two exterior layers 11, 12 and a wavy interior layer 13; coating the two exterior layers 11, 12 and the wavy interior layer 13 with adhesive, and gluing the wavy interior layer 13 between the two exterior layers 11, 12 to form a cardboard; printing of patterns or characters (not shown); cutting and pressing the cardboard into an unfolded sheet 14 of a shoebox with fold lines 141, and finally folding the unfolded sheet 14 into a shoebox.

In addition to the fact that the manufacturing process is too complicated since it involves the processes of gluing, cutting and folding, wastes will also be produced during the cutting process, which is cost intensive and environmentally unfriendly.

The conventional shoebox is only capable of being printed with two-dimensional patterns or characters, and the use of printing ink is detrimental to human health.

The present invention has arisen to mitigate and/or obviate the afore-described disadvantages.

SUMMARY OF THE INVENTION

The primary objective of the present invention is to provide a method for making a shoebox which is capable of reducing manufacturing cost by simplifying the manufacturing process.

Another objective of the present invention is to provide a method for making a shoebox which is environmentally friendly and capable of reducing manufacturing cost by producing no waste and requiring no printing process.

Yet another objective of the present invention is to provide a method for making a shoebox which is capable of forming a three-dimensional pattern on the shoebox.

To achieve the above objectives, a method for making a shoebox in accordance with the present invention comprises: a step of preparation, a step of forming a flat sheet of a semi-final product of an unfolded shoebox, a step of vacuum suction and mold movement, a step of forming a flat sheet of a final product of an unfolded shoebox, and a step of forming a shoebox.

The step of preparation includes preparing a pulp tank and a mold, the pulp tank is filled with pulp, and the mold includes a first upper mold, a first lower mold and a second lower mold. The first lower mold is movable in a vertical direction to press against or move away from the first upper mold and disposed in the pulp tank and includes a first cavity formed in the shape of an unfolded shoebox. The second lower mold is able to press against the first upper mold, and includes a second cavity formed in the same shape as the first cavity, and a third cavity formed in the shape of a pattern.

The step of forming a flat sheet of a semi-final product of the unfolded shoebox includes moving the first lower mold up from the pulp tank to press against the first upper mold, and pressing the pulp contained in the first cavity into the flat sheet of the semi-final product of the unfolded shoebox;

The step of vacuum suction and mold movement includes attracting the flat sheet of the semi-final product to the first upper mold by creating vacuum, via suction, inside the first upper mold, moving the first lower mold away from the first upper mold, moving the first upper mold together with the flat sheet of the semi-final product to a position above the second lower mold;

The step of forming a flat sheet of a final product of the unfolded shoebox includes hot pressing of the flat sheet of the semi-final product into the flat sheet of the final product of the unfolded shoebox with a pattern and fold lines by closing and heating the first upper mold and the second lower mold.

The step of forming the shoebox includes separating the first upper mold and the second lower mold, taking out and folding the flat sheet of the final product into the shoebox by folding along the fold lines.

Preferably, the pulp inside the pulp tank is produced from waste paper which is disintegrated into pulp by a pulp disintegrator.

Preferably, the pattern is embossed onto the flat sheet of the final product.

To achieve the above objectives, a method for making a shoebox in accordance with the present invention comprises:

The step of preparation includes preparing a pulp tank and a mold, the pulp tank is filled with pulp, and the mold includes a first upper mold, a first lower mold and a second lower mold. The first lower mold is movable in a vertical direction to press against or move away from the first upper mold and disposed in the pulp tank and includes a first cavity formed in the shape of an unfolded shoebox.

The step of forming a flat sheet of a final product of the unfolded shoebox includes moving the first lower mold up from the pulp tank and hot pressing pulp contained in the first cavity into the flat sheet of the final product of the unfolded shoebox with fold lines by closing and heating the first upper mold and the first lower mold.

The step of forming the shoebox includes separating the first upper and lower molds, taking out and folding the flat sheet of the final product into the shoebox by folding along the fold lines.

Preferably, the pulp inside the pulp tank is produced from waste paper which is disintegrated into pulp by a pulp disintegrator.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1A:
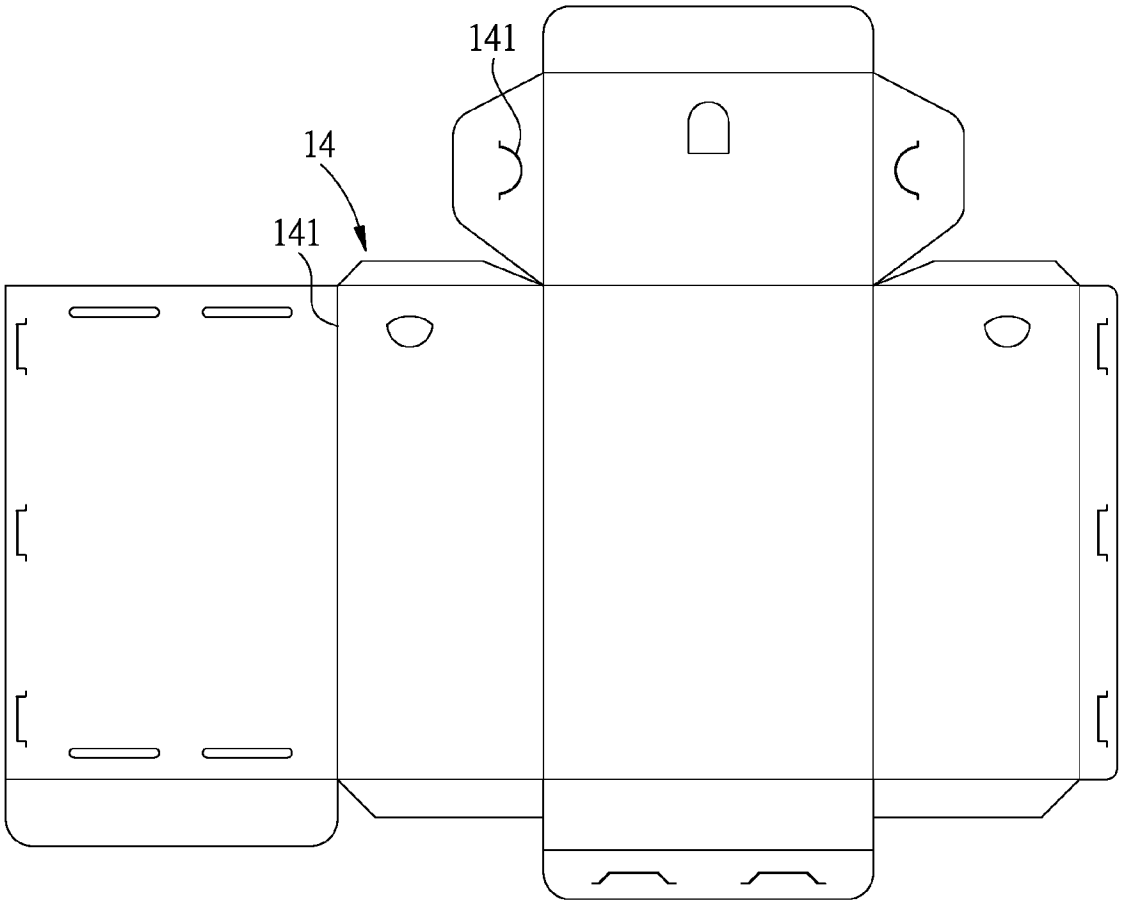
FIG.1A PRIOR ART
FIG. 1A shows a conventional unfolded shoebox.
Figure 1B:
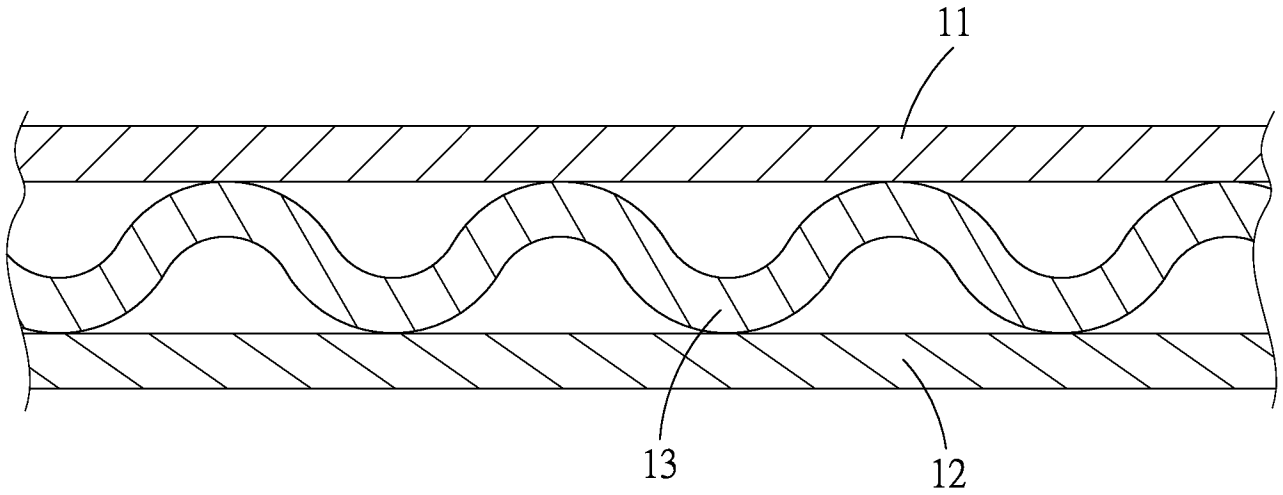
FIG.1B PRIOR ART
FIG. 1B is a cross sectional view of the conventional unfolded shoebox.
Figure 2:
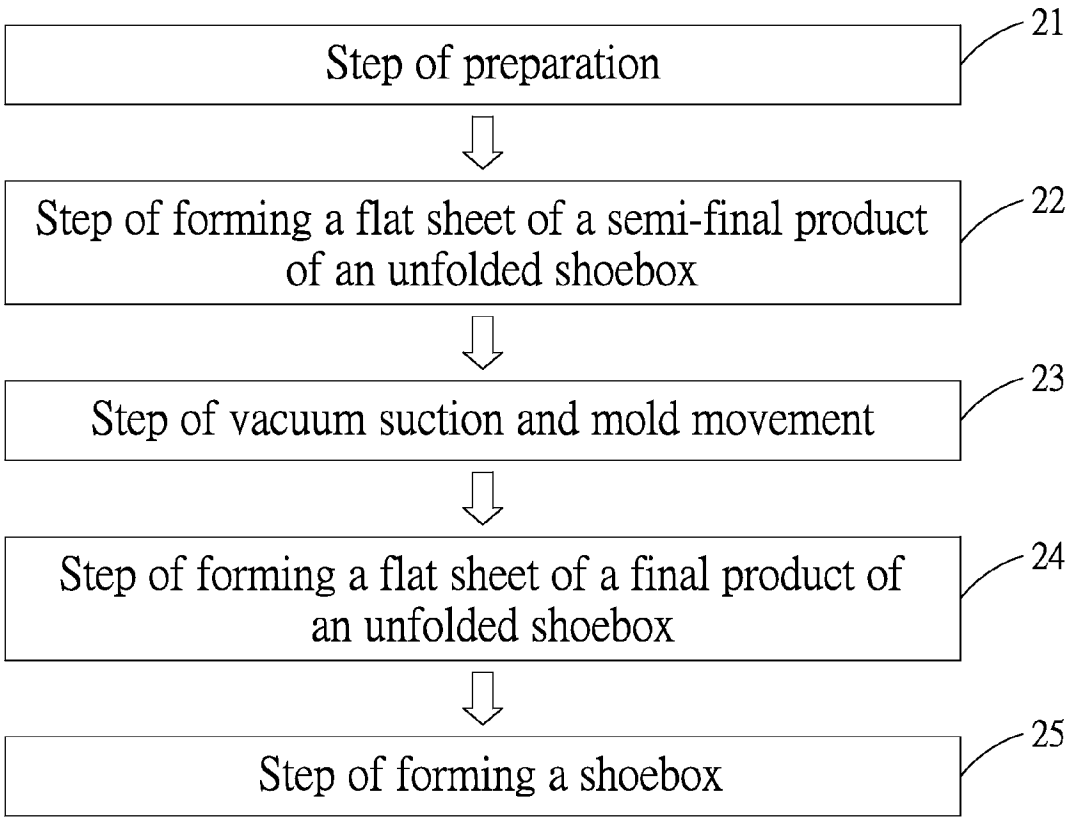
FIG. 2 is a flow chart of a method for making a shoebox in accordance with a preferred embodiment of the present invention.

Referring to FIG. 2, a method for making a shoebox in accordance with a preferred embodiment of the present invention comprises: a step 21 of preparation, a step 22 of forming a flat sheet of a semi-final product of an unfolded shoebox, a step 23 of vacuum suction and mold movement, a step 24 of forming a flat sheet of a final product of an unfolded shoebox, and a step 25 of forming a shoebox.

Figure 3:
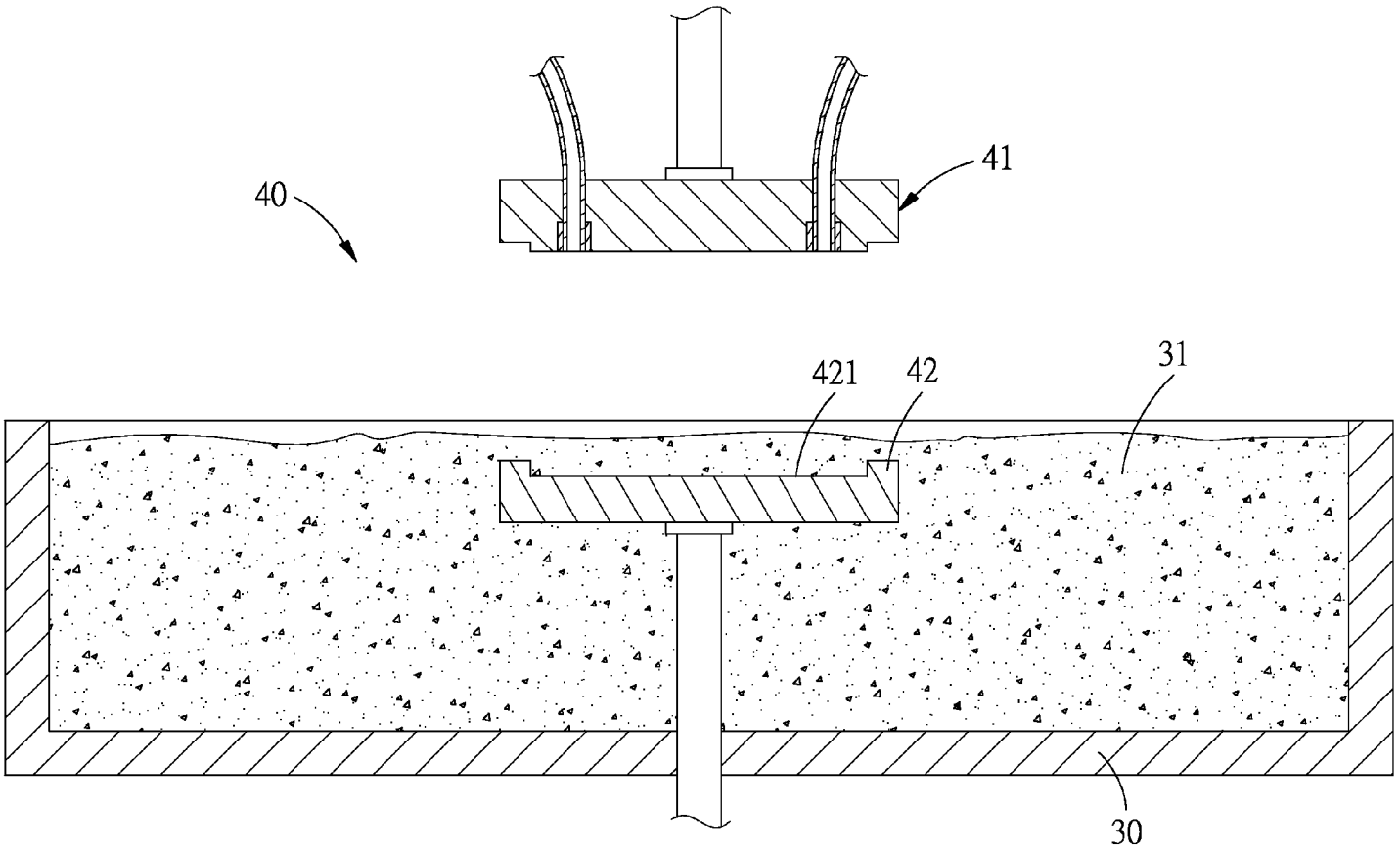
FIG. 3 is an illustrative view showing the step of preparation of the method for making a shoebox in accordance with the preferred embodiment of the present invention
Figure 4:
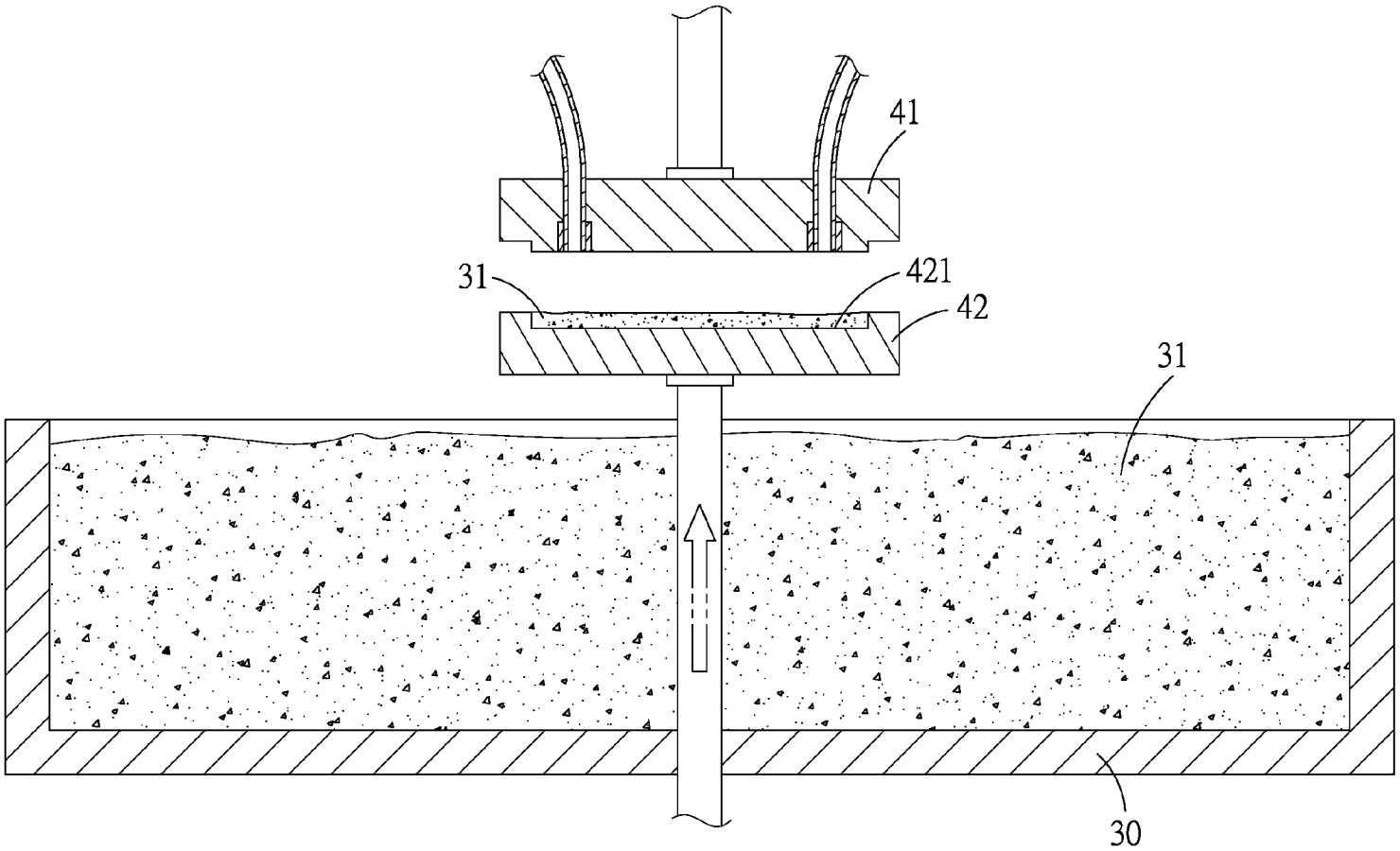
FIG. 4 is an illustrative view showing the step of forming a flat sheet of a semi-final product of an unfolded shoebox of the method for making a shoebox in accordance with the preferred embodiment of the present invention, wherein the first lower mold moves up from the pulp tank.
Figure 6:
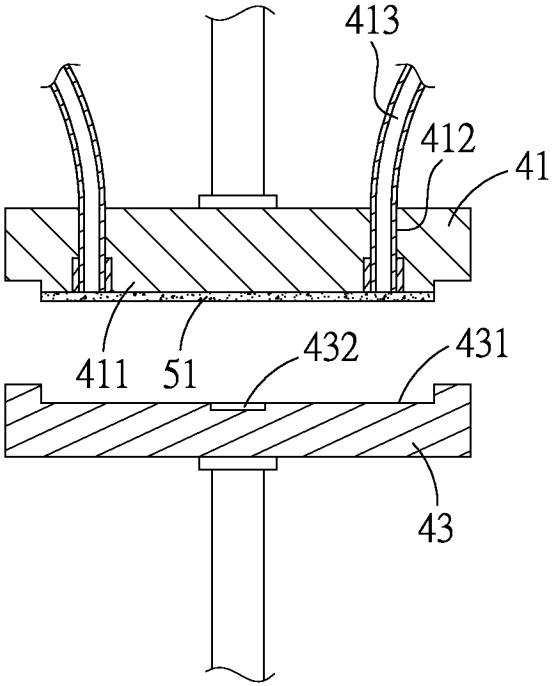
FIG. 6 is an illustrative view showing the step of forming a flat sheet of vacuum suction and mold movement of the method for making a shoebox in accordance with the preferred embodiment of the present invention.

As shown in FIG. 3 and FIG. 4, the step 21 of preparation involves preparing a pulp tank 30 and a mold 40. The pulp tank 30 is filled with pulp 31, and the mold 40 includes a first upper mold 41, a first lower mold 42 and a second lower mold 43 (as shown in FIG. 6). The first lower mold 42, which is movable in a vertical direction to press against or move away from the first upper mold 41, is disposed in the pulp tank 30 and includes a first cavity 421 formed in the shape of an unfolded shoebox. The second lower mold 43 is disposed outside the pulp tank 30 and located adjacent to the first lower mold. The second lower mold 43 is able to press against the first upper mold 41, and includes a second cavity 431 formed in the same shape as the first cavity 421, and a third cavity 432 formed in the shape of a pattern. In this embodiment, the pulp inside the pulp tank 30 is produced from waste paper which is disintegrated into pulp by a pulp disintegrator.

Figure 5:
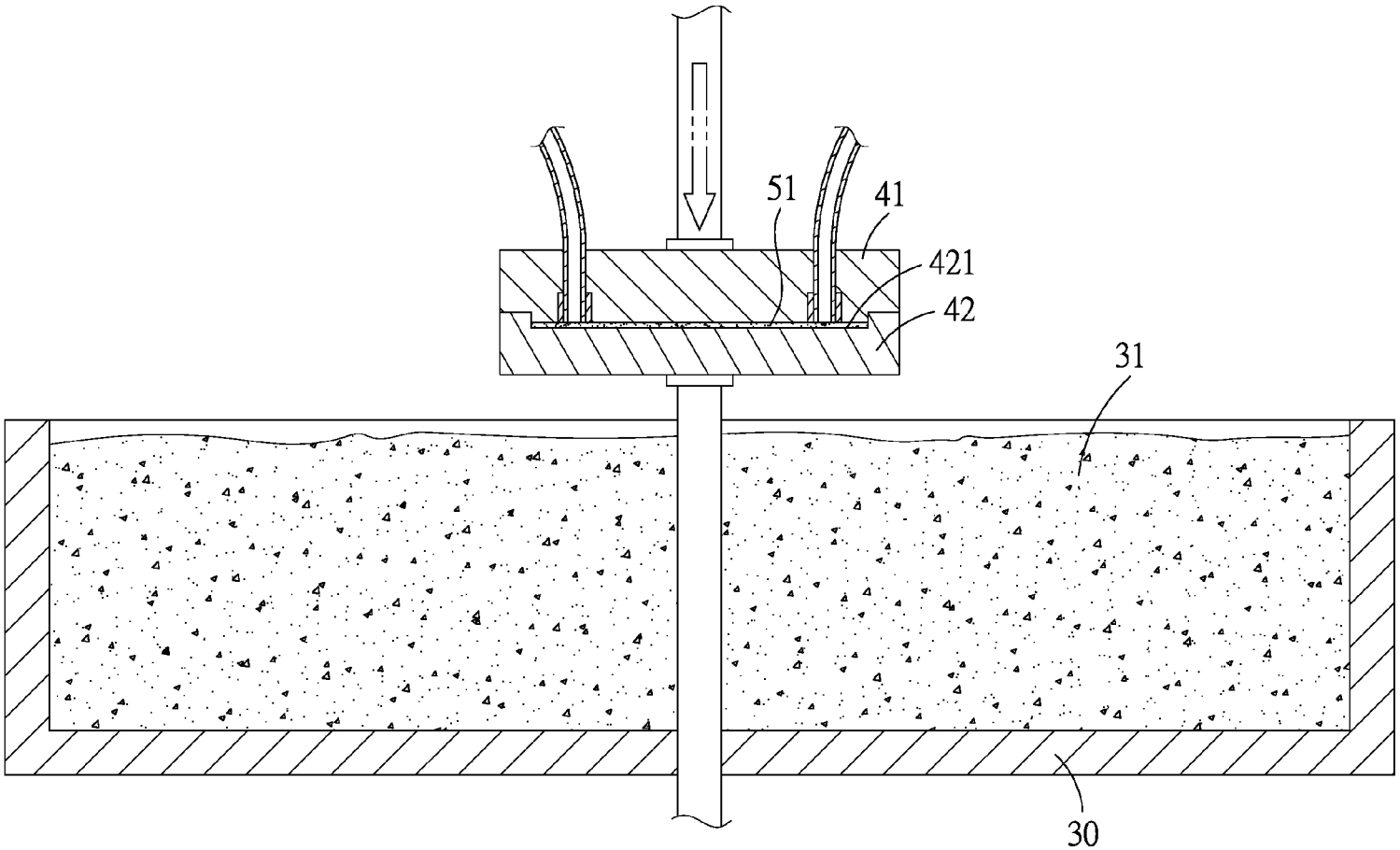
FIG. 5 is an illustrative view showing the step of forming a flat sheet of a semi-final product of an unfolded shoebox of the method for making a shoebox in accordance with the preferred embodiment of the present invention, wherein the first upper and lower molds are closed against each other.

As shown in FIGS. 4 and 5, the step 22 of forming a flat sheet of a semi-final product of an unfolded shoebox involves moving the first lower mold 42 up from the pulp tank 30 to press against the first upper mold 41, and pressing the pulp 31 contained in the first cavity 421 into a flat sheet of a semi-final product 51 of a unfolded shoebox.

As shown in FIGS. 5 and 6, the step 23 of vacuum suction and mold movement involves attracting the flat sheet of the semi-final product 51 to the first upper mold 41 by creating vacuum, via suction, inside the first upper mold 41, moving the first lower mold 42 away from the first upper mold 41, moving the first upper mold 41 together with the flat sheet of the semi-final product 51 to a position above the second lower mold 43. In this embodiment, the first upper mold 41 includes a protrusion 411 formed to fit in the first cavity 421, the flat sheet of the semi-final product 51 is attracted to the protrusion 411, and in the protrusion 411 are defined two suction holes 412 which are connected suction pipes 413. The flat sheet of the semi-final product 51 will be attracted to the first upper mold 41 after vacuum suction is performed via the suction holes 412.

Figure 7:
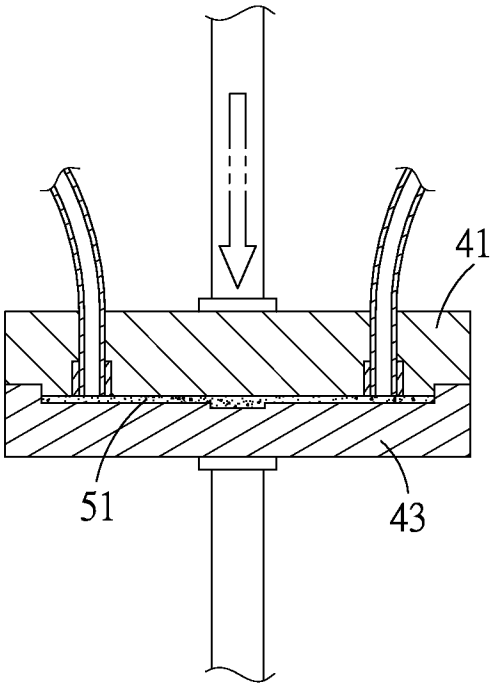
FIG. 7 is an illustrative view showing a step of forming a flat sheet of a final product of an unfolded shoebox of the method for making a shoebox in accordance with the preferred embodiment of the present invention.
Figure 8:
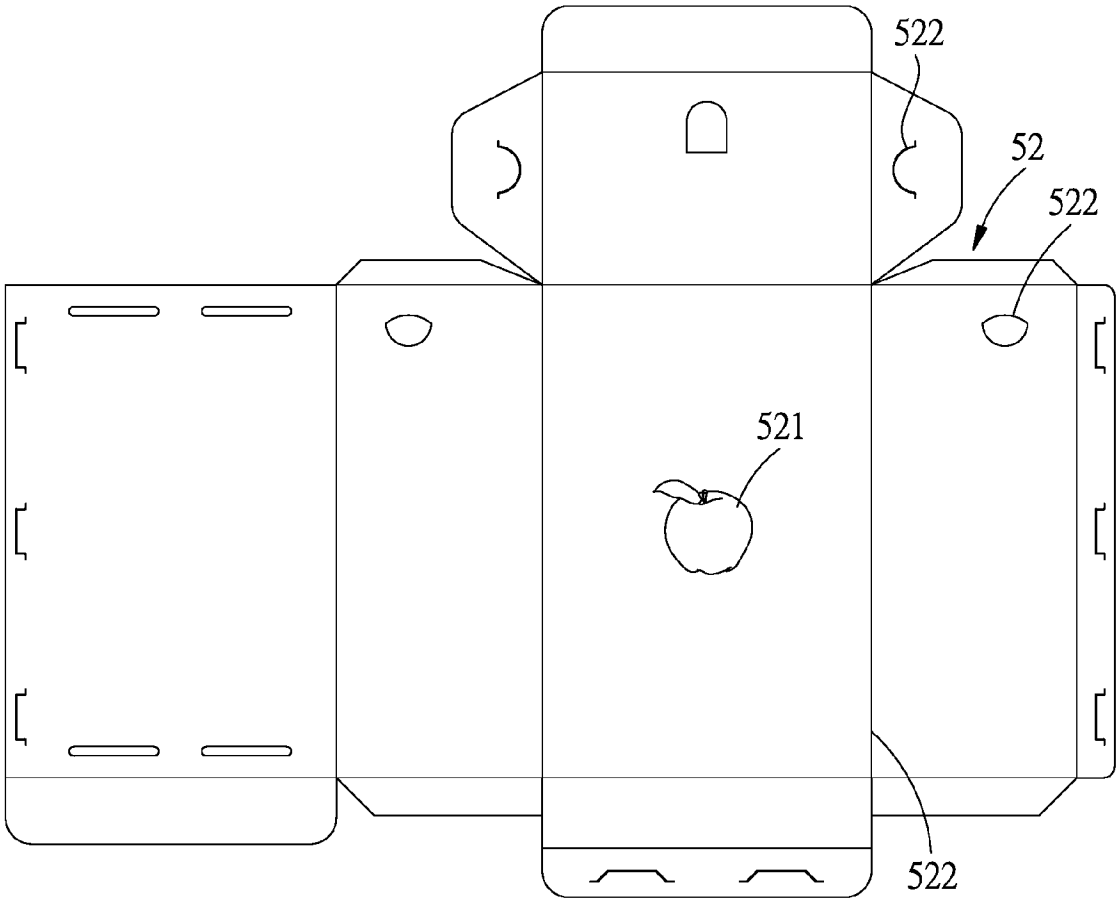
FIG. 8 is an illustrative view showing a step of forming a shoebox of the method for making a shoebox in accordance with the preferred embodiment of the present invention.
Figure 9:
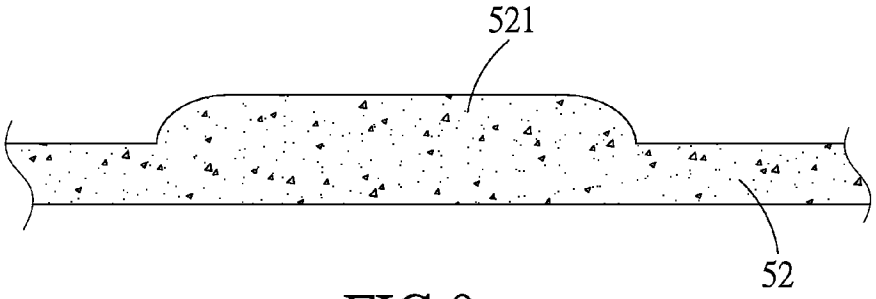
FIG. 9 is a cross sectional view of the flat sheet of the final product of the unfolded shoe box formed in the step of forming a flat sheet of a final product of an unfolded shoebox in accordance with the preferred embodiment of the present invention.
Figure 10:
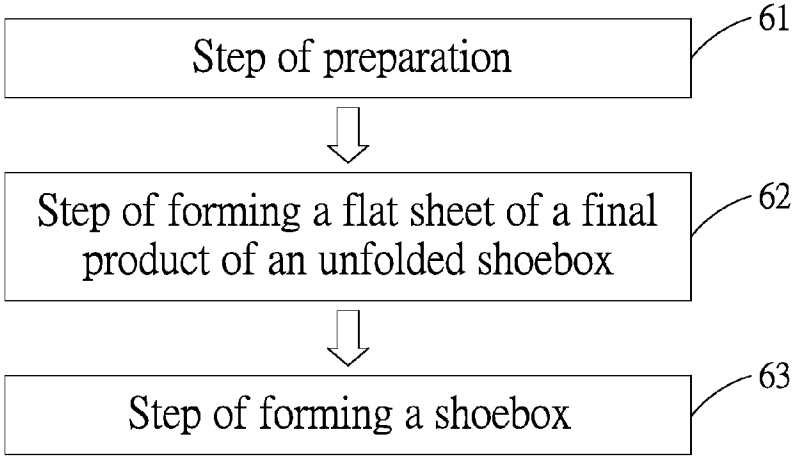
FIG. 10 is a flow chart of a method for making a shoebox in accordance with another preferred embodiment of the present invention.
Figure 11:
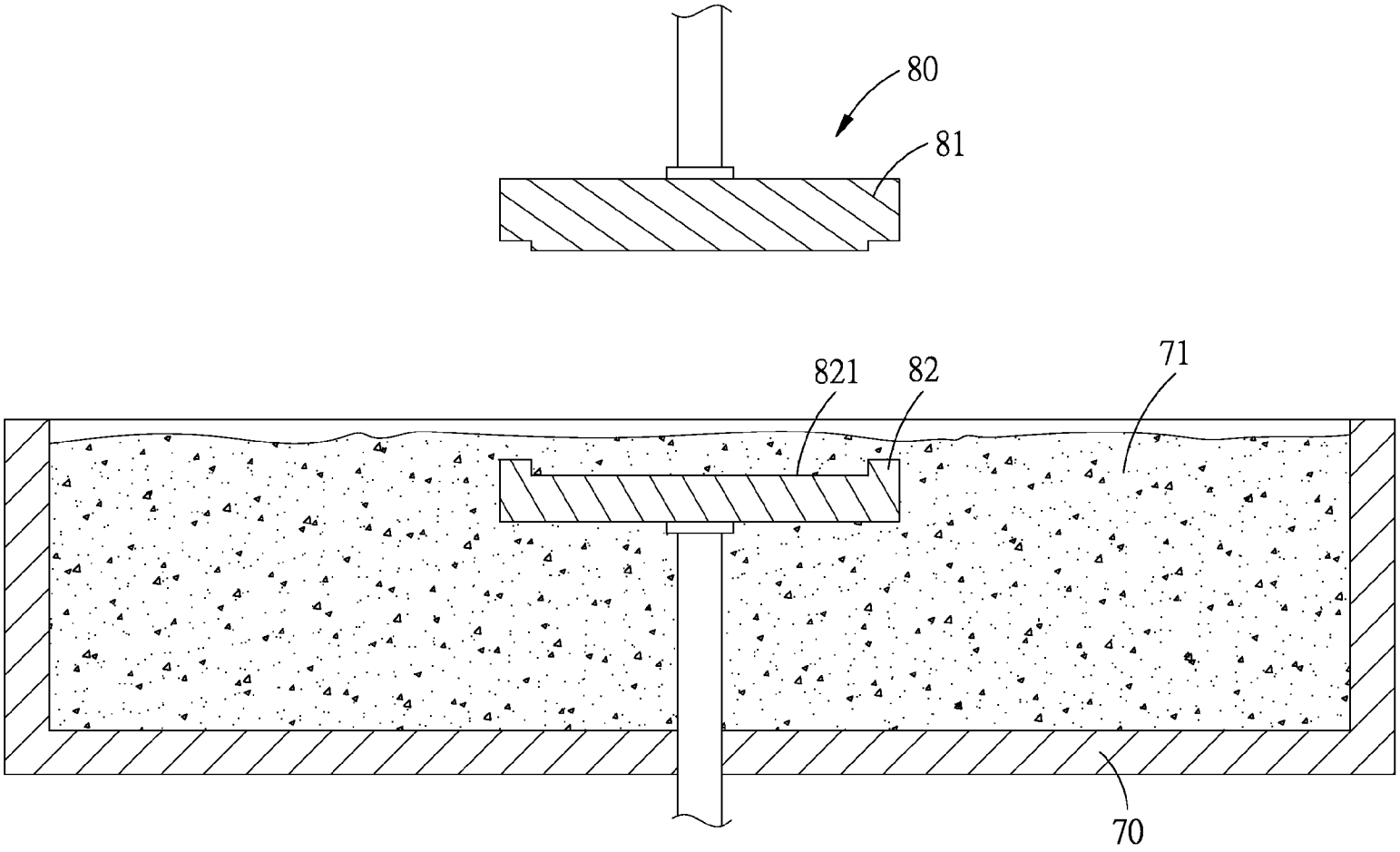
FIG. 11 is an illustrative view showing the step of preparation of the method for making a shoebox in accordance with the another preferred embodiment of the present invention
Figure 12:
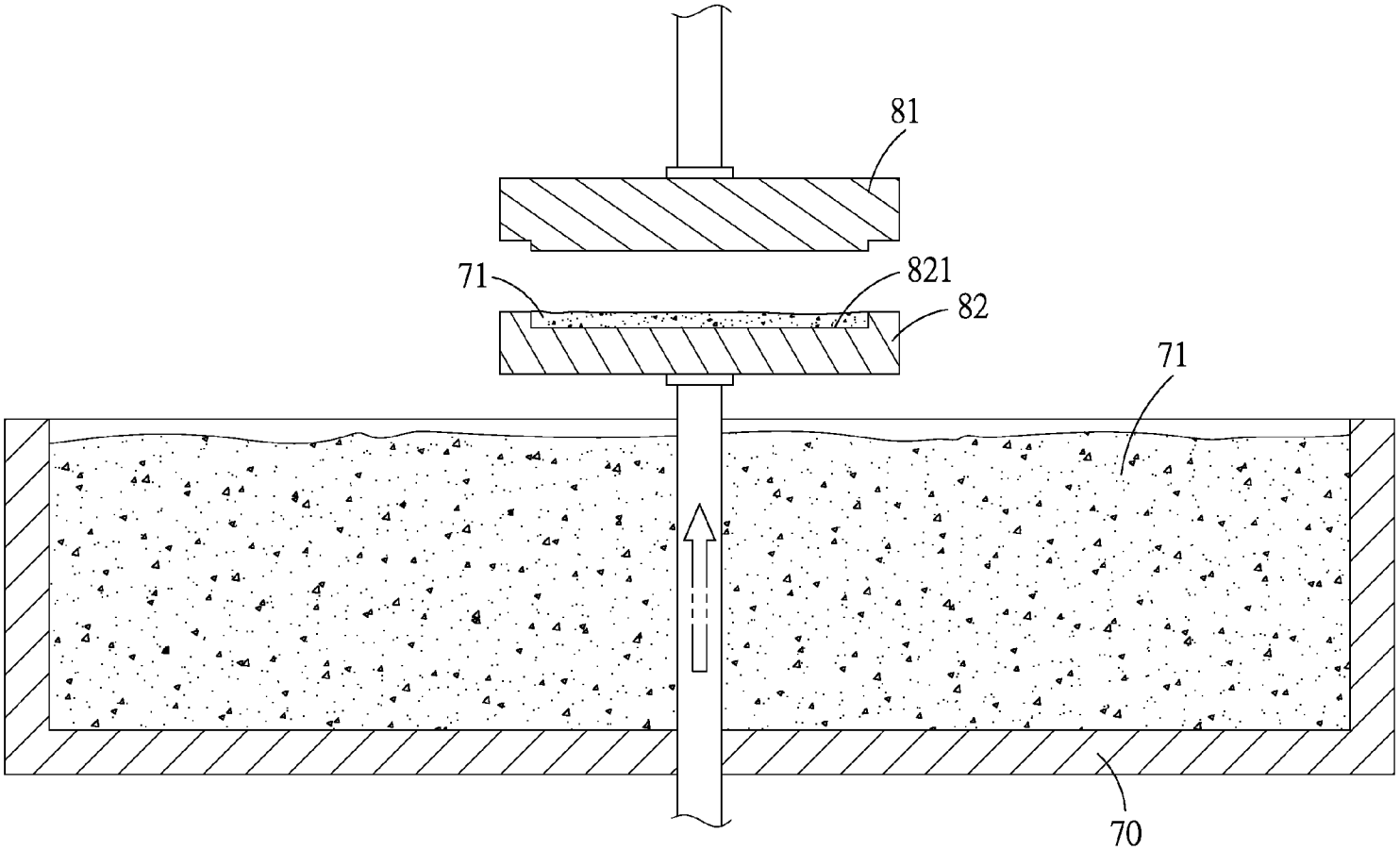
FIG. 12 is an illustrative view showing the step of forming a flat sheet of a final product of an unfolded shoebox of the method in accordance with the another preferred embodiment of the present invention, wherein the first lower mold moves up from the pulp tank.
Figure 13:
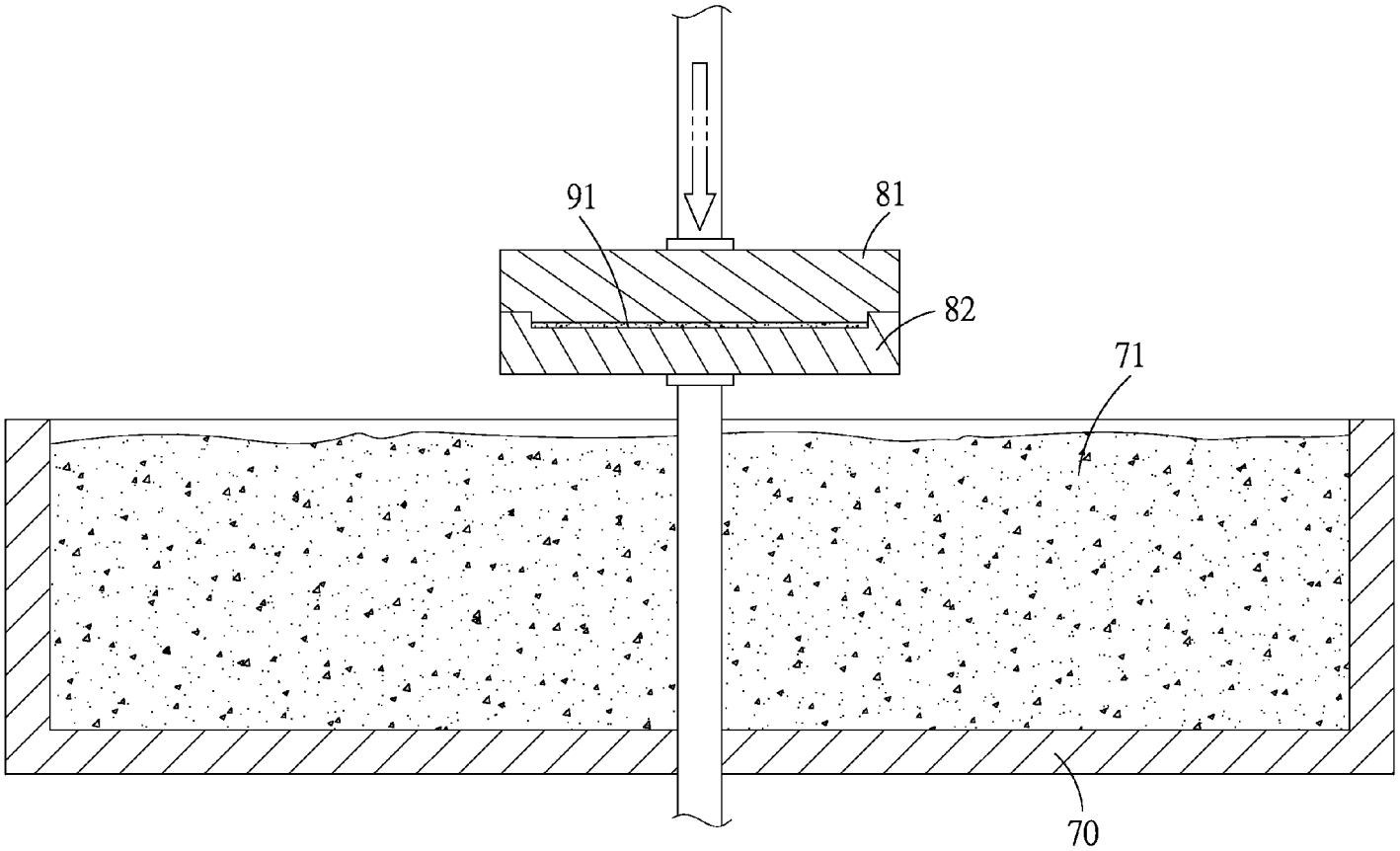
FIG. 13 is an illustrative view showing the step of forming a flat sheet of the final product of an unfolded shoebox of the method in accordance with the preferred embodiment of the present invention, wherein the first upper and lower molds are closed against each other.
Figure 14:
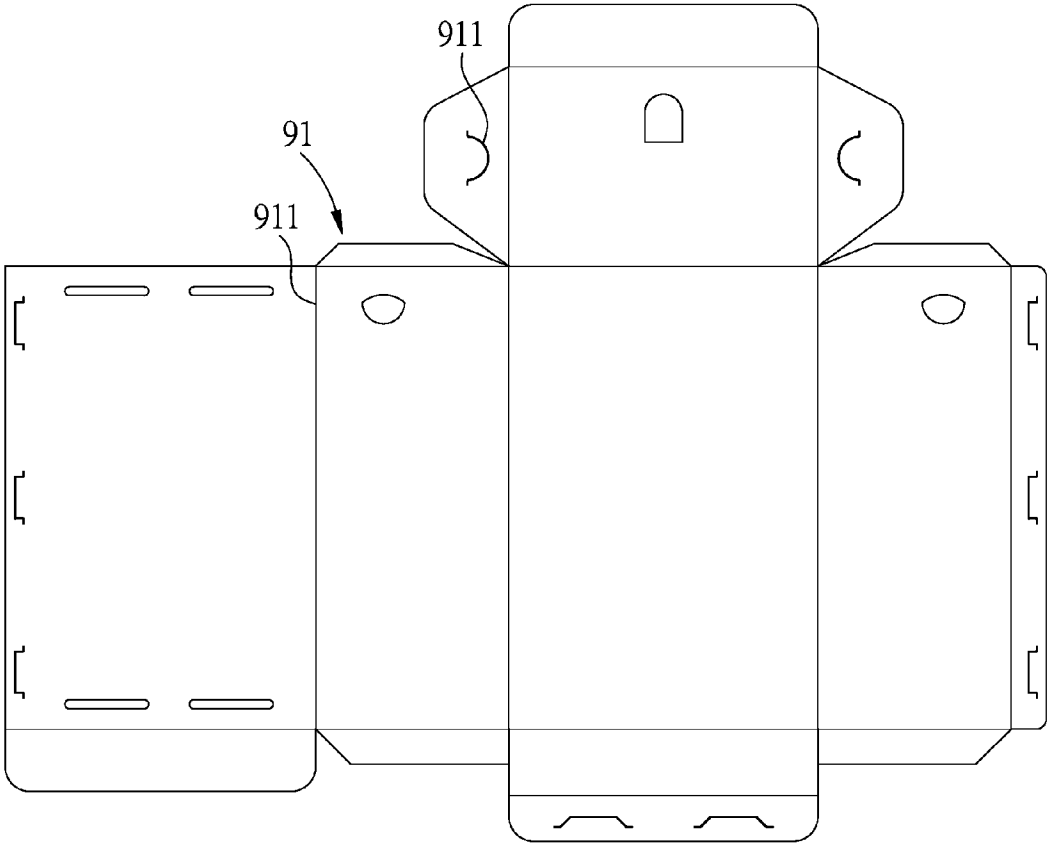
FIG. 14 is an illustrative view the flat sheet of the final product of the unfolded shoe box formed in the step of forming a flat sheet of a final product of an unfolded shoebox in accordance with the another preferred embodiment of the present invention.

Referring then to FIGS. 7-9, the step 24 of forming the flat sheet of a final product of an unfolded shoebox involves hot pressing of the flat sheet of the semi-final product 51 into a flat sheet of a final product 52 of the unfolded shoebox with a pattern 521 and fold lines 522 by closing and heating the first upper mold 41 and the second lower mold 43. In this embodiment, the patterns 521 is an apple embossed onto the final product 52 of the unfolded shoebox.

Referring to FIGS. 7 and 8 again, the step 25 of forming the shoebox involves separating the first upper mold 41 and the second lower mold 43, taking out and folding the flat sheet of the final product 52 into a shoebox by folding along the fold lines 522.

It is learned from the above description that the flat sheet of the final product 52 is a unitary piece, and can be folded directly into a shoebox without going through the processes of cutting, pressing and gluing, which simplifies the process and reduces the cost of shoebox making. The method for making a shoebox in accordance with the present invention is cost saving and environmentally friendly, since it requires no cutting process and produces no waste. Especially during the step 21 of preparation, the pulp inside the pulp tank 30 is made from recycled waste paper, which is more environmentally friendly.

The pattern 521 formed in the step 24 of forming the flat sheet of the final product of an unfolded shoebox is embossed onto the final product 52 of the unfolded shoebox, namely, the final product of the shoebox formed in the step 25 of forming the shoebox would have a three-dimensional pattern (which can be a trademark, logo or characters), which makes the products more distinctive. Furthermore, the embossed pattern 521 can be formed without going through printing process, which not only simplifies the shoebox manufacturing process, but also avoids the use of printing ink which is detrimental to human health.

Referring then to FIGS. 10-14, a method for making a shoebox in accordance with another preferred embodiment of the present invention comprises: a step 61 of preparation, a step 62 of forming a flat sheet of a final product of an unfolded shoebox, and a step 63 of forming a shoebox.

The step 61 of preparation involves preparing a pulp tank 70 and a mold 80. The pulp tank 70 is filled with pulp 31, and the mold 80 includes a first upper mold 81 and a first lower mold 82. The first lower mold 82, which is movable in a vertical direction to press against or move away from the first upper mold 81, is disposed in the pulp tank 70 and includes a first cavity 821 formed in the shape of an unfolded shoebox.

In this embodiment, the pulp inside the pulp tank 70 is produced from waste paper which is disintegrated into pulp by a pulp disintegrator.

The step 62 of forming the flat sheet of a final product of the unfolded shoebox involves moving the first lower mold 82 up from the pulp tank 70 and hot pressing of the pulp in the first cavity 821 into a flat sheet of a final product 91 of a unfolded shoebox with fold lines 911 by closing and heating the first upper mold 81 and the first lower mold 82.

The step 63 of forming the shoebox involves separating the first upper and lower molds 81, 82, taking out and folding the flat sheet of the final product 91 into a shoebox by folding along the fold lines 911.

It is learned from the above description that the final product 91 of the final product is a unitary piece, and can be folded directly into a shoebox without going through the processes of cutting, pressing and gluing, which simplifies the process and reduces the cost of shoebox making. The method for making a shoebox in accordance with the present invention is cost saving and environmentally friendly, since it requires no cutting process and produces no waste. Especially during the step 61 of preparation, the pulp inside the pulp tank 30 is made from recycled waste paper, which is more environmentally friendly.

While we have shown and described various embodiments in accordance with the present invention, it is clear to those skilled in the art that further embodiments may be made without departing from the scope of the present invention.

What is claimed is:

1. A method for making a shoebox comprising:

a step of preparation including preparing a pulp tank and a mold, the pulp tank being filled with pulp, and the mold including a first upper mold, a first lower mold and a second lower mold, the first lower mold being movable in a vertical direction to press against or move away from the first upper mold and disposed in the pulp tank and including a first cavity formed in the shape of an unfolded shoebox;

a step of forming a flat sheet of a semi-final product of the unfolded shoebox including moving the first lower mold up from the pulp tank to press against the first upper mold, and pressing the pulp contained in the first cavity into the flat sheet of the semi-final product of the unfolded shoebox;

a step of vacuum suction and mold movement including attracting the flat sheet of the semi-final product to the first upper mold by creating vacuum, via suction, inside the first upper mold, moving the first lower mold away from the first upper mold, moving the first upper mold together with the flat sheet of the semi-final product to a position above the second lower mold;

a step of forming a flat sheet of a final product of the unfolded shoebox including hot pressing of the flat sheet of the semi-final product into the flat sheet of the final product of the unfolded shoebox with a pattern and fold lines by closing and heating the first upper mold and the second lower mold; and a step of forming the shoebox including separating the first upper mold and the second lower mold, taking out and folding the flat sheet of the final product into the shoebox by folding along the fold lines;

wherein the second lower mold is disposed outside the pulp tank and adjacent to the first lower mold, and the second lower mold is able to press against the first upper mold, and includes a second cavity formed in the same shape as the first cavity, and a third cavity formed in the shape of the pattern.

2. The method for making the shoebox as claimed in claim 1, wherein the pulp inside the pulp tank is produced from waste paper which is disintegrated into pulp by a pulp disintegrator.

3. The method for making the shoebox as claimed in claim 1, wherein the pattern is embossed onto the flat sheet of the final product.

* * * * *